US008875468B2

(12) United States Patent
Dhinjan

(10) Patent No.: US 8,875,468 B2
(45) Date of Patent: Nov. 4, 2014

(54) WALL BEAD

(76) Inventor: Budha Singh Dhinjan, Warick (GB)

( * ) Notice: Subject to any disclaimer, the term of this patent is extended or adjusted under 35 U.S.C. 154(b) by 0 days.

(21) Appl. No.: 13/390,573

(22) PCT Filed: May 20, 2010

(86) PCT No.: PCT/GB2010/050827
§ 371 (c)(1),
(2), (4) Date: Feb. 15, 2012

(87) PCT Pub. No.: WO2011/023971
PCT Pub. Date: Mar. 3, 2011

(65) Prior Publication Data

US 2012/0174509 A1 Jul. 12, 2012

(30) Foreign Application Priority Data

Aug. 27, 2009 (GB) ..... 0914958.4

(51) Int. Cl.
*E04B 1/00* (2006.01)
*E04F 13/06* (2006.01)

(52) U.S. Cl.
CPC ..... *E04F 13/06* (2013.01); *E04F 2013/063* (2013.01)
USPC ..... 52/741.3; 52/255; 52/287.1; 52/631

(58) Field of Classification Search
USPC ..... 52/287.1, 288.1, 255, 631, 741.3; 411/461, 465, 466; 248/71; 403/283
See application file for complete search history.

(56) References Cited

U.S. PATENT DOCUMENTS

| | | | | | |
|---|---|---|---|---|---|
| 450,753 | A | * | 4/1891 | Cary | 217/70 |
| 483,040 | A | * | 9/1892 | Binet | 217/67 |
| D29,728 | S | * | 11/1898 | Roberts | D8/389 |
| 778,809 | A | * | 12/1904 | Stokes | 411/467 |
| 1,212,219 | A | * | 1/1917 | Hescheles | 411/466 |
| 1,373,036 | A | * | 3/1921 | Upson | 411/466 |
| 1,470,251 | A | * | 10/1923 | Ahlvin | 403/281 |
| 1,953,303 | A | * | 4/1934 | Kohlmann | 206/499 |
| 2,012,203 | A | * | 8/1935 | Peterson | 52/255 |
| 2,174,145 | A | * | 9/1939 | Tummins | 52/489.2 |
| 2,353,140 | A | * | 7/1944 | Belanger | 411/461 |
| 2,396,030 | A | * | 3/1946 | Terry | 285/405 |
| 2,643,423 | A | * | 6/1953 | Brendel | 52/255 |
| 2,826,352 | A | * | 3/1958 | Holtkamp | 411/466 |
| 2,851,741 | A | * | 9/1958 | Stemples | 52/255 |
| 2,859,445 | A | * | 11/1958 | Larrabee | 72/325 |
| 2,862,264 | A | * | 12/1958 | Perna | 52/287.1 |
| 2,904,856 | A | * | 9/1959 | Robinson | 52/255 |
| 3,090,087 | A | * | 5/1963 | Miller | 52/287.1 |
| 3,109,207 | A | * | 11/1963 | Cooper | 52/255 |

(Continued)

OTHER PUBLICATIONS

International Search Report in counterpart PCT (PCT/GB2010/050827).

*Primary Examiner* — William Gilbert
*Assistant Examiner* — Gisele Ford
(74) *Attorney, Agent, or Firm* — Muskin & Farmer LLC

(57) ABSTRACT

A wall bead 10 comprising a central longitudinally extending portion 13, a first elongate flange 11, and second elongate flange 12 which extend longitudinally of the bead, and which separately comprise a front and rear surface. The wall bead 10 further comprises a plurality of teeth 16 disposed upon the first and second flange at longitudinal positions thereon, wherein the teeth are directed away from the respective flange, substantially forwardly of the respective flange, along a common direction that is along the wall bead.

13 Claims, 6 Drawing Sheets

(56) References Cited

U.S. PATENT DOCUMENTS

Figure 1B:
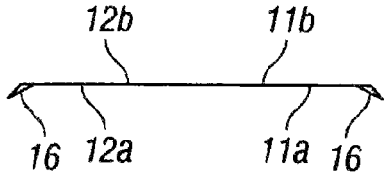

| | | | | | |
|---|---|---|---|---|---|
| 3,170,162 | A | * | 2/1965 | Balinski | 72/325 |
| 3,255,561 | A | * | 6/1966 | Cable | 52/255 |
| 3,276,797 | A | * | 10/1966 | Humes, Jr. | 52/715 |
| 3,286,280 | A | * | 11/1966 | Duggan | 4/252.2 |
| 3,305,252 | A | * | 2/1967 | Jureit | 403/170 |
| 3,323,264 | A | * | 6/1967 | Cross | 52/281 |
| 3,417,652 | A | * | 12/1968 | Menge | 411/466 |
| 3,498,171 | A | * | 3/1970 | Jureit | 411/466 |
| 3,828,514 | A | * | 8/1974 | Jureit | 403/230 |
| 3,881,293 | A | * | 5/1975 | Conville | 52/712 |
| 4,324,079 | A | * | 4/1982 | Pearson | 52/255 |
| 4,486,115 | A | * | 12/1984 | Rionda et al. | 403/283 |
| 4,722,153 | A | * | 2/1988 | Hardy | 52/255 |
| 4,807,417 | A | * | 2/1989 | Bell | 52/699 |
| 4,863,774 | A | * | 9/1989 | Tucker | 428/77 |
| 4,876,837 | A | | 10/1989 | Kelly | |
| 5,048,247 | A | * | 9/1991 | Weldy | 52/255 |
| 5,131,198 | A | * | 7/1992 | Ritchie et al. | 52/287.1 |
| 5,138,810 | A | * | 8/1992 | Kartler | 52/254 |
| 5,442,886 | A | * | 8/1995 | Iacobelli | 52/255 |
| 5,544,463 | A | * | 8/1996 | Bergin | 52/254 |
| 5,613,335 | A | * | 3/1997 | Rennich et al. | 52/255 |
| 5,752,353 | A | * | 5/1998 | Koenig et al. | 52/255 |
| 5,778,617 | A | | 7/1998 | Free | |
| 5,836,122 | A | * | 11/1998 | Rennich et al. | 52/254 |
| 5,904,016 | A | * | 5/1999 | Koenig et al. | 52/255 |
| 5,943,835 | A | * | 8/1999 | von Saint-George | 52/287.1 |
| 6,073,406 | A | * | 6/2000 | Kearney | 52/287.1 |
| 6,171,043 | B1 | * | 1/2001 | Williams | 411/466 |
| 6,212,836 | B1 | * | 4/2001 | Larson | 52/287.1 |
| 6,295,776 | B1 | * | 10/2001 | Kunz et al. | 52/255 |
| 6,363,673 | B1 | * | 4/2002 | Robertson | 52/255 |
| 6,438,914 | B1 | * | 8/2002 | Robertson | 52/255 |
| 6,539,680 | B2 | * | 4/2003 | Kunz et al. | 52/256 |
| 6,571,520 | B2 | * | 6/2003 | Koenig et al. | 52/287.1 |
| 6,615,557 | B2 | * | 9/2003 | Smythe, Jr. | 52/287.1 |
| 6,655,101 | B2 | * | 12/2003 | Harel | 52/287.1 |
| 6,691,477 | B2 | * | 2/2004 | Koenig. Jr. et al. | 52/287.1 |
| 6,722,082 | B1 | * | 4/2004 | Peterson et al. | 49/428 |
| 6,758,017 | B2 | * | 7/2004 | Young | 52/255 |
| 6,779,313 | B2 | * | 8/2004 | Smythe, Jr. | 52/255 |
| 7,013,610 | B2 | * | 3/2006 | Kunz | 52/255 |
| 7,021,879 | B2 | * | 4/2006 | Taneichi | 411/466 |
| 7,214,434 | B2 | * | 5/2007 | Dalgleish et al. | 428/537.5 |
| 7,383,668 | B1 | * | 6/2008 | Kunz | 52/255 |
| 8,046,963 | B2 | * | 11/2011 | Wambaugh et al. | 52/287.1 |

* cited by examiner

WALL BEAD

This Application is a national stage filing under 35 U.S.C. 371 of International Application No. PCT/GB2010/050827, filed on May 20, 2010 which claims priority to application 0914958.4, filed in Great Britain on Aug. 27, 2009, both applications of which are incorporated by reference herein in their entireties.

The present invention relates to a wall bead for applying across two adjoining surfaces of a wall, such as a corner, prior to the application of a surface coating thereto.

It is well known to apply a surface coating of plaster or other render material, to ceilings and other wall surfaces in buildings. Generally, prior to applying the plaster or the material, an elongate bead of metal is applied along external corners where two intersecting surfaces meet, in order to enable a good finish to be achieved to the corner. The bead also acts to strengthen and protect the corner.

U.S. Pat. No. 4,876,837 discloses a typical corner bead which is formed from an elongate strip of sheet metal and comprises a rounded nose and two mounting flanges extending perpendicular to each other from the opposite sides of the nose. The mounting flanges are apertured to provide a key for the overlying plaster or render.

The corner bead is applied to a corner by passing nails or screws through the apertured mounting flanges into the underlying wall material. However, a disadvantage of this arrangement is that the underlying wall material is often too hard or too soft to readily accept nails or screws and thus the process of applying corner beads can be difficult and time consuming. In order to overcome this problem, it is has been proposed to attach corner beads using an adhesive. However, the corner beads have to be held in place whilst the adhesive sets and it will be appreciated that this is equally as difficult as permanently securing the corner beads. Another disadvantage of using adhesive is that the adhesive has to be allowed to set before the underlying wall is plastered or rendered.

U.S. Pat. No. 5,778,617 discloses a corner bead which attempts to overcome the above-mentioned problems and which comprises a plurality of integral pre-formed barbs along its length for securing the corner bead to underlying wall surfaces formed of plasterboard or other drywall material. In use, when a corner bead is applied to the plasterboard the barbs penetrate the outer layer of the plasterboard and temporarily secure the corner bead to the corner whilst it is plastered over. A disadvantage of this arrangement is that the barbs extend substantially perpendicular to the bead and so once the bead has been fixed to the wall surface it can be very difficult to remove or reposition the bead without unduly damaging the underlying plasterboard.

A first aspect of the invention provides a wall bead, the wall bead comprising a central longitudinally extending portion and a first and second elongate flange which extend longitudinally of the bead, and which separately comprise a front and rear surface, the wall bead further comprising a plurality of teeth disposed upon the first and second flange at longitudinal positions thereon, wherein the teeth extend at an acute angle to the respective flange, substantially forwardly of the respective flange and generally in the longitudinal direction of the respective flange, along a common direction.

Since all the teeth are arranged to extend along a common direction, then the wall bead can couple with a plasterboard for example, by pushing the wall bead into and along the plasterboard, so as to "hook" the wall bead onto the plasterboard. If it becomes necessary to reposition the wall bead, then the wall bead can be lifted off the plasterboard so as to release the teeth and thus "un-hook" the wall bead without tearing the plasterboard.

Preferably, the teeth comprise first blades configured to extend from the front surface of the respective flange and the wall bead further comprises a corresponding plurality of second blades disposed upon the first and second flanges, each second blade extending generally perpendicularly forwardly of the front surface of the respective flange, and the first and second blades being arranged in spaced pairs at longitudinal positions along the respective flange.

Each blade may comprise a pointed distal end and is generally triangular in shape. Alternatively, each blade may comprise a generally straight distal end and generally has the shape of a truncated triangle.

Preferably, each blade comprises a cutting edge having a non-linear profile.

Alternatively, the teeth may comprise barbs configured to extend from a longitudinal edge of the respective flange.

The first and second flanges preferably extend from opposite sides of a central longitudinally-extending portion of the wall bead. In an embodiment, the first and second flanges preferably extend in substantially the same plane. It is envisaged that wall bead would find suitable application in bridging across joins between boards that extend in substantially the same plane.

In an embodiment the front surface of the first and second flanges are preferably angularly spaced about the central longitudinally-extending portion by an angle less than 180°. Preferably, the angular spacing between the front surface of the first and second flange is substantially 90°. Alternatively, the angular spacing between the front surface of the first and second flange is substantially 45°. It is envisaged that the wall bead would find suitable application in covering external corners between plasterboards.

In an embodiment the front surface of the first and second flanges are preferably angularly spaced about the central longitudinally-extending portion by an angle greater than 180°. It is envisaged that the wall bead would find suitable application in covering internal corners between plasterboards.

Preferably, the first and second flanges are apertured to provide a key for overlying plaster or render. Preferably, the apertures on the first and second flange further provide for additional fixing of the wall bead to a wall using screws and nails, for example.

A second aspect of the invention provides a method of manufacturing a wall bead, the method comprising:

providing a wall bead comprising a central longitudinally extending portion and a first and second elongate flange which extend longitudinally of the bead, and which separately comprise a front and rear surface;

forming a plurality of cuts in each elongate flange, each cut extending from an elongate edge of the respective elongate flange towards the central longitudinally extending portion; and pushing each section of flange located between a respective elongate edge and a respective cut generally away from the respective elongate flange until each said section extends generally forwardly of the respective elongate flange at an acute angle to the respective flange, to thereby form a plurality of teeth extending generally in the longitudinal direction of the respective flange, along a common direction.

A third aspect of the invention provides a method of coupling a wall bead to a wall, the method comprising the use of a wall bead according to the first aspect of the present invention, the method comprising the steps of:

pushing the wall bead onto the wall so that the barbs, which extend from the front surface of the first and second flange, penetrate into the wall; and sliding the wall bead along the wall so that the barbs move along the wall.

Figure 1A:
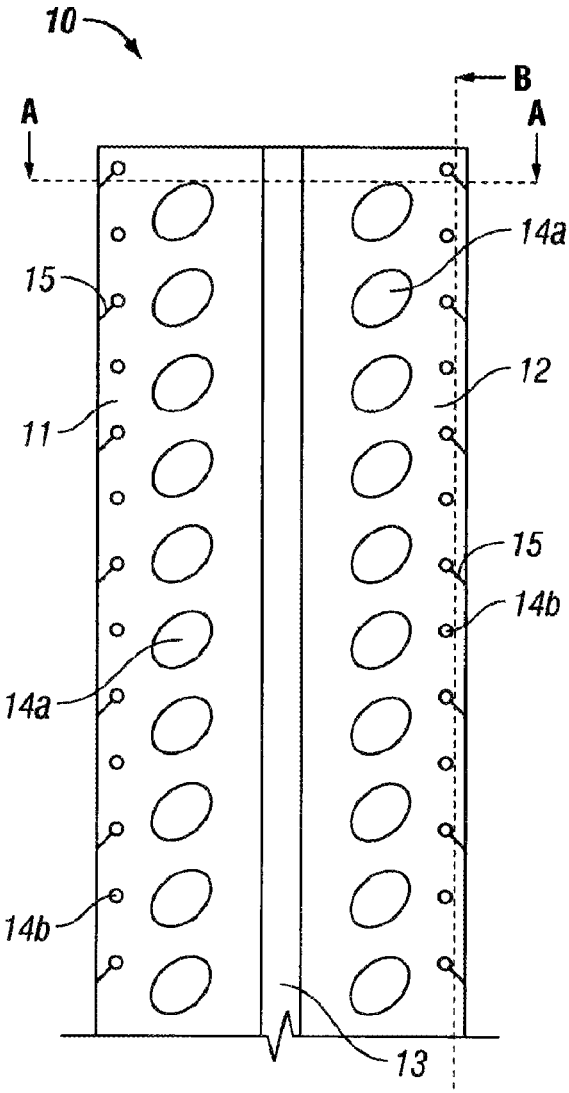
Figure 1C:
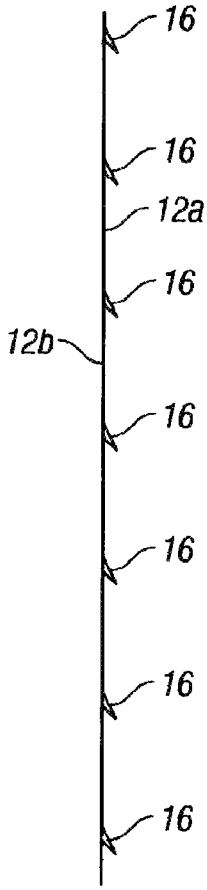

Embodiments of the present invention will now be described by way of example only and with reference to the accompanying drawings, in which:

FIG. 1*a* is perspective view of a section of a wall bead according to a first embodiment of the invention;

FIG. 1*b* is a sectional view across the wall bead of FIG. 1*a*, taken along line A-A;

FIG. 1*c* is a sectional view across the wall bead of FIG. 1*a*, taken along line B-B.

Figure 2A:
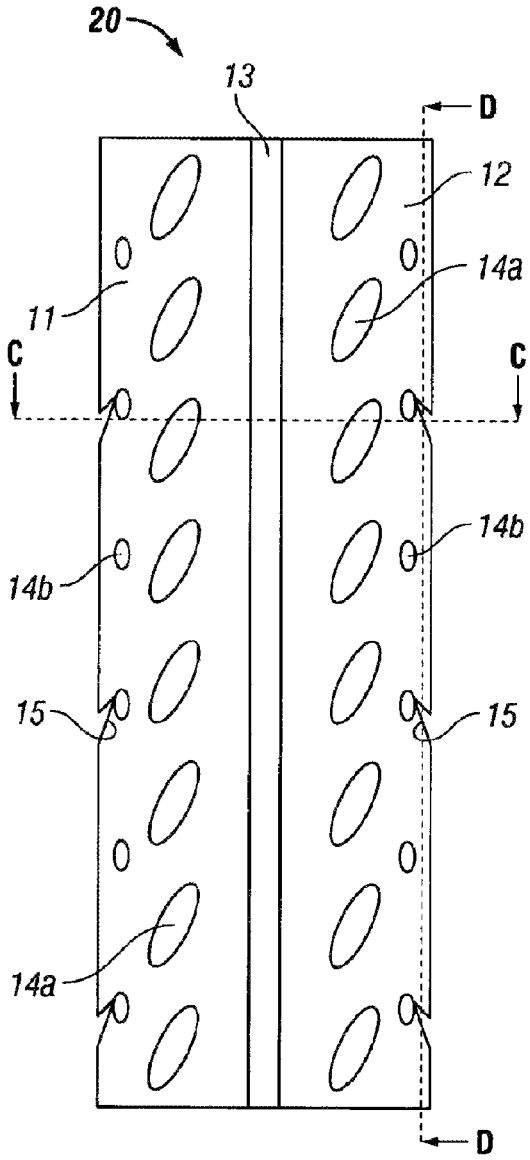
Figure 2B:
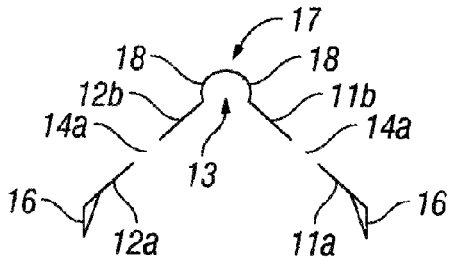
Figure 2C:
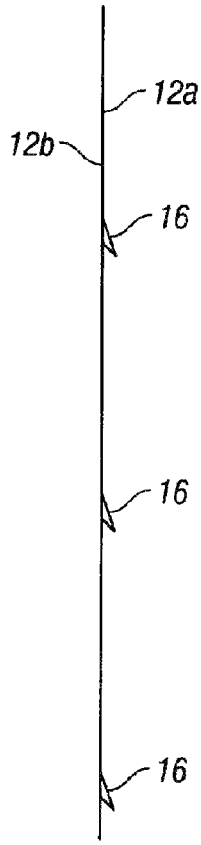

FIG. 2*a* is perspective view of a wall bead according to a second embodiment of the invention;

FIG. 2*b* is a sectional view across the wall bead of FIG. 2*a*, taken along line C-C;

FIG. 2*c* is a sectional view across the wall bead of FIG. 2*a*, taken along line D-D.

Figure 3A:
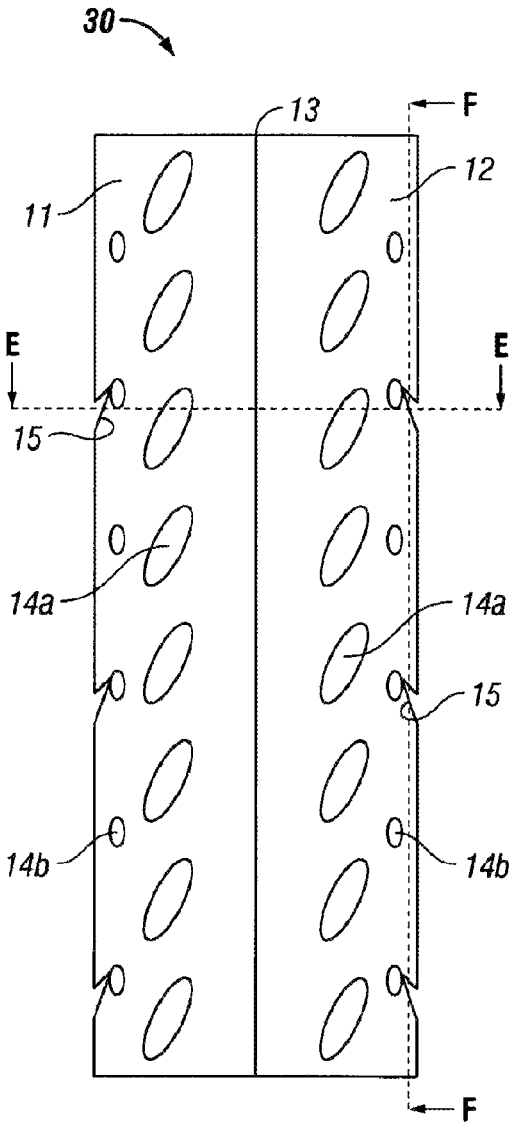
Figure 3B:
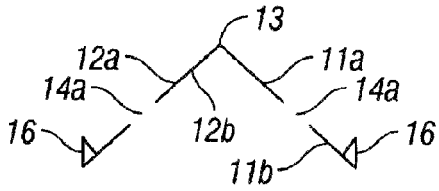
Figure 3C:
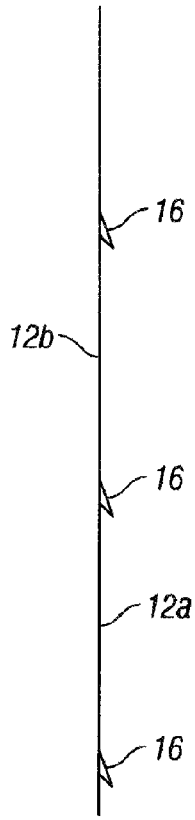
Figure 4A:
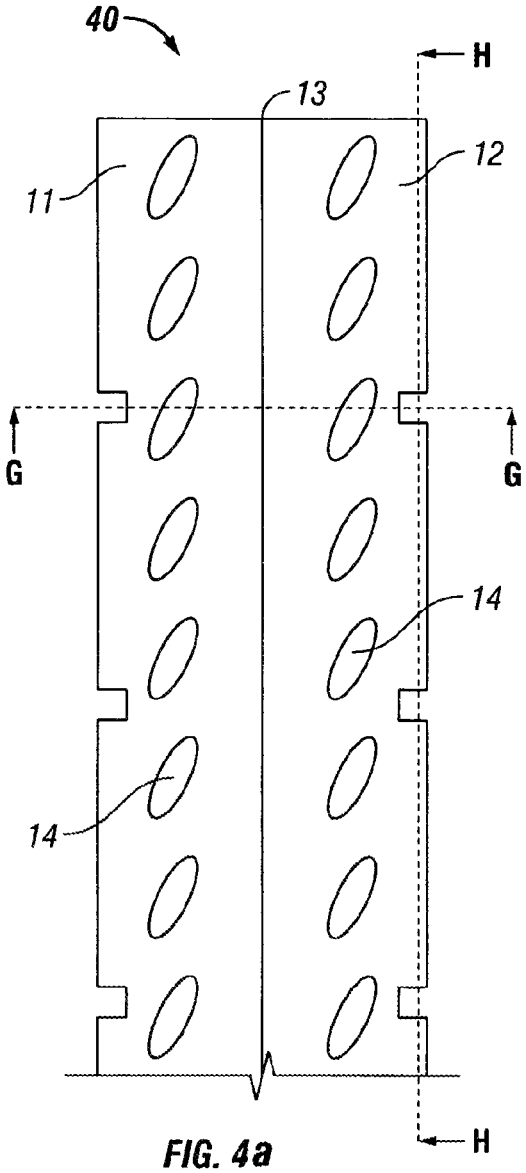
Figure 4B:
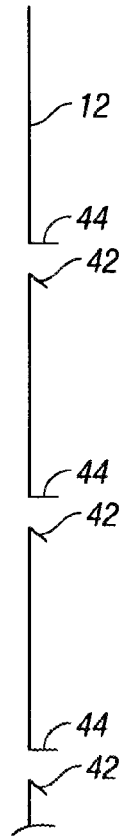
Figure 4C:
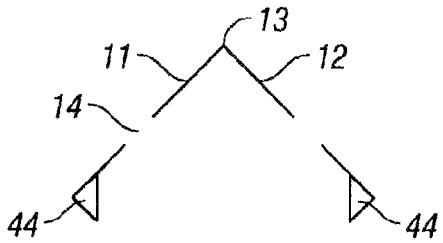
Figure 4D:
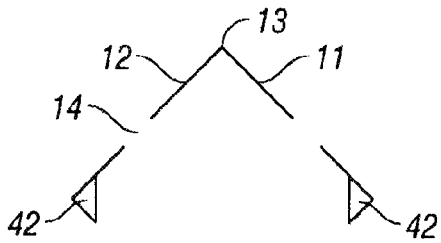
Figure 5:
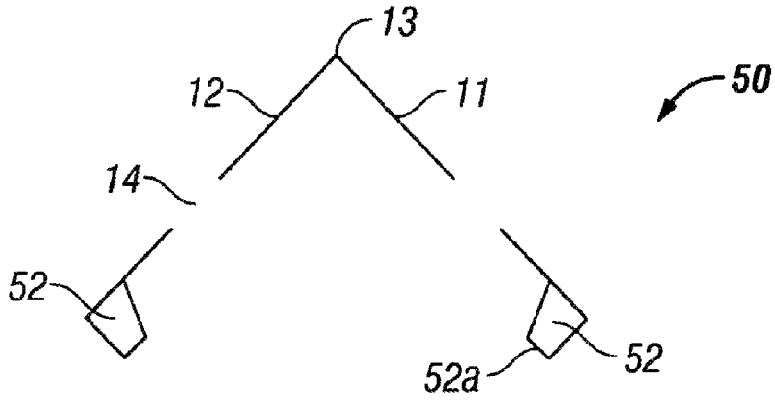
Figure 6A:
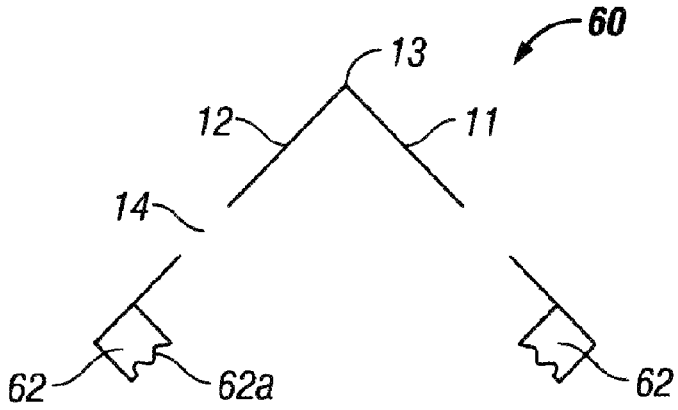
Figure 6B:
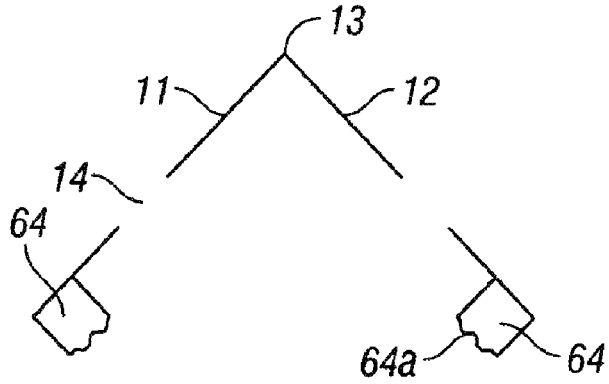
Figure 7:
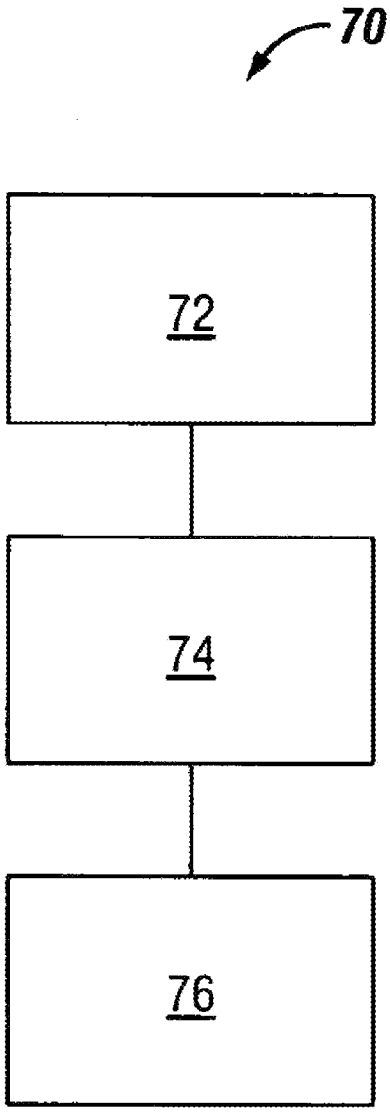

FIG. 3*a* is perspective view of a section of a wall bead according to a third embodiment of the invention;

FIG. 3*b* is a sectional view across the wall bead of FIG. 3*b*, taken along line E-E;

FIG. 3*c* is a sectional view across the wall bead of FIG. 3*a*, taken along line F-F;

FIG. 4*a* is perspective view of a section of a wall bead according to a fourth embodiment of the invention;

FIG. 4*b* is a sectional view across the wall bead of FIG. 4*a*, taken along line H-H;

FIG. 4*c* is a sectional view in one direction across the wall bead of FIG. 4*a*, taken along line G-G;

FIG. 4*d* is a sectional view in the opposite direction across the wall bead of FIG. 3*a*, taken along line G-G;

FIG. 5 a sectional view in one direction across a wall bead according to a fifth embodiment of the invention;

FIG. 6*a* a sectional view in one direction across a wall bead according to a sixth embodiment of the invention;

FIG. 6*b* a sectional view in the opposite direction across the wall bead of the sixth embodiment of the invention; and FIG. 7 shows the steps of a method of manufacturing a wall bead according to a seventh embodiment of the invention.

Referring to FIG. 1, there is illustrated a wall bead 10 according to a first embodiment of the invention which may be roll-formed from an elongate strip of galvanised steel, for example. The wall bead 10 comprises a first and second elongate flange 11, 12, which separately extend from one side of a central, longitudinally-extending portion 13 of the wall bead 10. The wall bead further comprises a plurality of teeth, in the form of barbs 16, longitudinally spaced along the first and second flanges.

The first and second flanges 11, 12 are formed integrally with the central longitudinally-extending portion 13 and extend along the wall bead 10. The first and second flanges 11, 12 separately comprise a front 11*a*, 12*a* and rear surface 11*b*, 12*b*, and a plurality of apertures 14 which extend along each flange 11, 12 to provide a key for overlying plaster or render (not shown). The wall bead 10 comprises a plurality of substantially elliptical apertures 14*a* disposed along a central longitudinal axis of each flange 11, 12 and a plurality of substantially circular apertures 14*b*, disposed proximate to a distal longitudinal edge 11*c*, 12*c* of each flange 11, 12.

In this embodiment, alternate circular apertures 14*b* formed in the first and second flange 11, 12 are opened by a cut 15, which extends from the respective aperture 14*b* through the distal longitudinal edge 11*c*, 12*c* of the respective flange 11, 12. The cuts 15 are formed at an acute angle to the distal longitudinal edge 11*c*, 12*c* of the respective flange 11, 12, so that upon deforming the portion of the wall bead 10 between the circular aperture 14*b* and the respective adjacent, distal edge 11*c*, 12*c*, out of the plane of the respective flange 11, 12, a barb 16 is formed.

Each barb 16 is turned away from the plane of the first and second flange 11, 12 in a direction that is forwardly of the front surface 11*a*, 12*a* of the respective flange 11, 12 and is arranged to extend at an acute angle to the plane of the respective flange 11, 12, so that each barb 16 extends in a direction that is substantially along the respective flange 11, 12. The cuts 15 formed along the wall bead 10 are similarly orientated so that each barb 16 is substantially the same size and extends in substantially the same direction.

In this embodiment, the first and second flanges 11, 12 are arranged to extend in substantially the same plane either side of the central longitudinally-extending portion 13 so that the bead 10 can be used to bridge across a join between two plasterboards (not shown) for example, which also extend in substantially the same plane.

In use, the wall bead 10 is secured to a wall (not shown) by first cutting the wall bead 10 to the appropriate length and then aligning the wall bead 10 to the wall so that the central, longitudinally-extending portion 13 extends substantially along a join between plasterboards on the wall for example, with the barbs 16 directed substantially downwardly of the wall. The wall bead 10 is then pushed against the wall, so that the first and second flanges 11, 12 extend to either side of the join between the plasterboards, for example, and so that the barbs 16 penetrate the plasterboard surface. The wall bead 10 is then moved downwardly relative to the plasterboards, so that the wall bead 10 becomes hooked onto the plasterboards by the barbs 16. If further fixing is required then screws and nails (not shown) for example, may be passed in to the wall through the apertures 14 formed on the wall bead 10.

If it becomes necessary to reposition or otherwise remove the wall bead 10, then the wall bead 10 may be lifted so as to un-hook the barbs 16 from the plasterboard and subsequently lifted away from the plasterboards. This ensures that the barbs 16 do not rip or tear the plasterboard and thus damage the boards.

FIG. 2 shows a wall bead 20 according to a second embodiment of the invention. The wall bead 20 of this embodiment is substantially the same as the wall bead 10 of FIG. 1, with the following modifications. The same reference numbers are retained for corresponding features.

In this embodiment, the angular spacing between the front surfaces 11*a*, 12*a* of the first and second flanges 11, 12, about the central, longitudinally-extending portion 14 is arranged to be less than 180°, such as 90°. The wall bead 20 is thus arranged to extend around an external corner between two walls (not shown), which typically form a 90°. It is to be appreciated however, that the angular spacing between the front surfaces 11*a*, 12*a* of the first and second flanges 11, 12 about the central, longitudinally-extending portion 13, can be arranged to accommodate external corners formed with any angular separation of walls.

The central, longitudinally-extending portion 13 comprises an arcuate nose 17 portion which extends between the first and second flange 11, 12. The nose portion 17 extends slightly above the plane of the first and second flange 11, 12 to provide a lip 18 that is used as a finishing edge for the overlying plaster or render (not shown) for example.

Referring to FIG. 3 of the drawings, there is illustrated a wall bead 30 according to a third embodiment of the invention. The wall bead 30 of this embodiment is substantially the same as the wall bead 10 of FIG. 1, with the following modifications. The same reference numbers are retained for corresponding features.

In this embodiment the angular spacing between the front surfaces 11*a*, 12*a* of the first and second flanges 11, 12, about the central, longitudinally-extending portion 13 is arranged to be greater than 180°, such as 270°. Such an embodiment is arranged to extend around an internal corner (not shown) between two walls (not shown), which typically form a 90°. It is to be appreciated however, that the angular spacing between the front surfaces 11*a*, 12*a* of the first and second flanges 11, 12 about the central, longitudinally-extending portion 13, can be arranged to accommodate internal corners formed with any angular separation of walls.

FIG. 4 shows a wall bead 40 according to a fourth embodiment of the invention. The wall bead 40 is substantially the same as the wall bead 30 of FIG. 3, with the following modifications. The same reference numbers are retained for corresponding features.

In this embodiment, the teeth take the form of a plurality of first blades 42 provided on the first and second flange 11, 12 at longitudinal positions along the flange. The first blades 42 extend at an acute angle to the respective flange 11, 12, substantially forwardly of the respective flange. The first blades 42 extend generally in the longitudinal direction of the respective flange 11, 12, along a common direction.

The wall bead 40 further comprises a corresponding plurality of second blades 44 provided on the first and second flanges 11, 12. The second blades 44 extend generally perpendicularly forwardly of a front surface of the respective flange, as seen most clearly in FIG. 4*b*. The first and second blades 42, 44 are arranged in spaced pairs, at longitudinal positions along the respective flange 11, 12.

In this example, each blade 42, 44 is generally triangular in shape and has a pointed distal end, as seen in FIGS. 4*c* and *d*.

The first and second blades 42, 44 are formed by first and second cuts extending at an angle from the edge of the respective flange 11, 12 towards the longitudinally-extending portion 13. The sections of flange 11, 12 between the edge and the respective cut are then pushed generally away from the respective flange 11, 12, until each section extends generally forwardly at an acute angle to the flange 11, 12. A triangular section of material is left between the two blade sections, and this can be cut and removed.

In use, the wall bead 40 is secured to a wall by cutting the wall bead 40 to an appropriate length and aligning the wall bead 40 to the wall so that the central, longitudinally-extending portion 13 extends substantially along a join between plasterboards on the wall. With the first blades 42 orientated generally downwardly of the wall, the wall bead 40 is pushed against the wall, and downwardly towards the wall, so that the first blades 42 penetrate the plasterboard surface in the direction of movement of the wall bead 40. The second blades 44 are also pushed into the plasterboard surface during this movement, and are additionally caused to deform, being bent as the wall bead 40 is moved. The teeth blades 42, 44 thereby engage with the plasterboard, and fix the wall bead 40 in place on the plasterboard. If further fixing is required, screws or nails may be located through one or more of the apertures 14 into the plasterboard.

A fifth embodiment of the invention provides a wall bead 50 as shown in cross-section in FIG. 5. The wall bead 50 is substantially the same as the wall bead 40 of FIG. 4, with the following modifications. The same reference numbers are retained for corresponding features.

In this embodiment, the first blades 52 have a generally straight distal end 52*a*, and generally have the shape of a truncated triangle, that is a triangle having one corner removed.

A sixth embodiment of the invention provides a wall bead 60 as shown in cross section in one direction in FIG. 6*a* and in cross section in the other direction in FIG. 6*b*. The wall bead 60 is substantially the same as the wall bead 40 of FIG. 4, with the following modifications. The same reference numbers are retained for corresponding features.

In this embodiment, the first blades 62*a* have a generally square shape with a forward most edge, being the cutting edge, having a non-linear profile. In this example, the cutting edge has a waved profile. The second blades 64 are similarly generally square shaped with a complimentary non-linear (wavy) profiled cutting edge 64*a*.

A seventh embodiment of the invention provides a method 70 of manufacturing a wall bead, the steps of which are shown in FIG. 7.

The method 70 comprises:

providing a wall bead comprising a central longitudinally extending portion and a first and second elongate flange which extend longitudinally of the bead, and which separately comprise a front and rear surface 72;

forming a plurality of cuts in each elongate flange, each cut extending from an elongate edge of the respective elongate flange towards the central longitudinally extending portion 74; and pushing each section of flange located between a respective elongate edge and a respective cut generally away from the respective elongate flange until each said section extends generally forwardly of the respective elongate flange at an acute angle to the respective flange, to thereby form a plurality of teeth extending generally in the longitudinal direction of the respective flange, along a common direction 76.

From the foregoing therefore, it is evident that the wall beads described above provide a simple yet effective means of fixing and re-positioning a wall bead to a wall.

The invention claimed is:

1. A method of manufacturing a wall bead, the method comprising:

providing a wall bead comprising a central longitudinally extending portion and a first and second elongate flange which extend longitudinally of the bead, and which separately comprise a front and rear surface;

forming a plurality of cuts in each elongate flange, each cut extending from an elongate edge of the respective elongate flange towards the central longitudinally extending portion; and pushing each section of flange located between a respective elongate edge and a respective cut generally away from the respective elongate flange until each said section extends generally forwardly of the respective elongate flange at an acute angle to the respective flange, to thereby form a plurality of teeth extending generally in the longitudinal direction of the respective flange, along a common direction.

2. A wall bead, the wall bead comprising:

a central longitudinally extending portion and a first and second elongate flange which extend longitudinally of the bead, and which separately comprise a front and rear surface, the wall bead further comprising a plurality of teeth disposed upon the first and second flange at longitudinal positions thereon and at the respective distal longitudinal edges thereof, wherein the teeth extend at an acute angle relative to a longitudinal direction of the respective flange, such that a respective distal end of each respective tooth furthest from the respective flange is longitudinally offset from a respective proximal end of each respective tooth closest to the respective flange, substantially forwardly of the respective flange, each tooth extending in the same longitudinal direction of the respective flange as the teeth immediately longitudinally adjacent thereto.

3. A wall bead as claimed in claim 2, wherein the teeth comprise first blades configured to extend from the front surface of the respective flange and the wall bead further comprises a corresponding plurality of second blades disposed upon the first and second flanges, each second blade extending generally perpendicularly forwardly of the front surface of the respective flange, and the first and second blades being arranged in spaced pairs at longitudinal positions along the respective flange.

4. A wall bead as claimed in claim 3, wherein each blade comprises a pointed distal end and is generally triangular in shape.

5. A wall bead as claimed in claim 3, wherein each blade comprises a generally straight distal end and generally has the shape of a truncated triangle.

6. A wall bead as claimed in claim 3, wherein each blade comprises a cutting edge having a non-linear profile.

7. A wall bead as claimed in claim 2, wherein the teeth comprise barbs.

8. A wall bead as claimed in claim 2, wherein the first and second flanges extend from opposite sides of the central longitudinally-extending portion of the wall bead.

9. A wall bead as claimed in claim 2, wherein, the first and second flanges extend in substantially the same plane.

10. A wall bead as claimed in claim 2, wherein the front surface of the first and second flanges are angularly spaced about the central longitudinally-extending portion by an angle less than 180°.

11. A wall bead as claimed in claim 10, wherein the angular spacing between the front surface of the first and second flange is substantially 90°.

12. A wall bead as claimed in claim 10, wherein the angular spacing between the front surface of the first and second flange is substantially 45°.

13. A wall bead as claimed in claim 2, wherein the front surface of the first and second flanges are angularly spaced about the central longitudinally-extending portion by an angle greater than 180°.

* * * * *